US006242747B1

(12) United States Patent
Sugitani et al.

(10) Patent No.: US 6,242,747 B1
(45) Date of Patent: Jun. 5, 2001

(54) METHOD AND SYSTEM FOR OPTIMIZING LINAC OPERATIONAL PARAMETERS

(75) Inventors: Michiro Sugitani, Niihama; Hiroyuki Kariya, Saijo; Mitsukuni Tsukihara, Ehime; Kenji Sawada, Niihama, all of (JP)

(73) Assignee: Axcelis Technologies, Inc., Beverly, MA (US)

( * ) Notice: Subject to any disclaimer, the term of this patent is extended or adjusted under 35 U.S.C. 154(b) by 0 days.

(21) Appl. No.: 09/336,457

(22) Filed: Jun. 18, 1999

(30) Foreign Application Priority Data

Jun. 19, 1998 (JP) ..... 10-173200

(51) Int. Cl.[7] ..... G21K 5/00
(52) U.S. Cl. ..... 250/396 R; 250/251
(58) Field of Search ..... 250/251, 294, 250/295, 296, 297, 298, 299, 300, 396 R, 492.1, 492.3, 423 R, 423 F

(56) References Cited

U.S. PATENT DOCUMENTS 5,168,241 * 12/1992 Hirota et al. .
5,693,939 12/1997 Purser ..... 250/251
5,719,403 2/1998 Purser ..... 250/492.21
5,719,478 2/1998 Washio et al. ..... 315/500
5,796,219 8/1998 Hirakimoto et al. ..... 315/500
5,882,947 3/1999 Lin et al. ..... 438/14

* cited by examiner

*Primary Examiner*—Charles Bowers
*Assistant Examiner*—Evan Pert
(74) *Attorney, Agent, or Firm*—John A. Kastelic

(57) ABSTRACT

A method and apparatus is provided for controlling the operational parameters of a radio frequency (RF) linear accelerator (linac) (23) in an ion implanter (1). An operator or a higher level computer enters into an input device (10) the desired type of ions, the ionic valence value of ions, the extraction voltage of ion source (21), and the final energy value that is needed. Using internally stored numeric value calculation codes in parameter storage device (18), a control calculation device (11) simulates the ion beam acceleration or deceleration, and the anticipated dispersion of the ion beam, and calculates the RF linac operational parameters of amplitude, frequency and phase for obtaining an optimum transport efficiency. The parameter related to the amplitude is sent from control calculation device (11) to amplitude control device (12) which adjusts the amplitude of the output of RF power supply (15). The parameter related to the phase is sent to phase control device (13), which adjusts the phase of the output of RF power supply (15). The parameter related to the frequency is sent to frequency control device (14). Frequency control device (14) controls the output frequency of RF power supply (15) while it also controls the resonance frequency of RF resonator (23-1) of RF linac (23).

20 Claims, 5 Drawing Sheets

METHOD AND SYSTEM FOR OPTIMIZING LINAC OPERATIONAL PARAMETERS

FIELD OF THE INVENTION

The present invention pertains to an ion implantation apparatus for implanting ions into targets such as silicon wafers, and more particularly to a method and system for optimizing the operational parameters of a linear accelerator (linac) in such an apparatus.

BACKGROUND OF THE INVENTION

In an ion implantation apparatus having a conventional acceleration system, operational parameters regarding the acceleration of the ions in the beam can be easily obtained by analysis. For example, in an acceleration method which utilizes an electrostatic field, typical in most ion implantation apparatuses, the required voltage (V) of a power supply which is used to create the electrostatic field is simply obtained by the following equation (1) using the ionic valence value (n) of the desired ions and the desired energy (E) of the ions, typically measured in kilo-electron volts (keV).

$$V=E/n \tag{1}$$

When the electric field is applied in multiple stages, the sum of all of the fields can be made to be equal to the value V.

However, in an ion implantation apparatus utilizing a radio frequency (RF) linear accelerator (linac), comprised of resonator modules each having an accelerating electrode, both the amplitude (in kilovolts (kV)) and the frequency (in Hertz (Hz)) of the accelerating electrode output signal must be determined as operating parameters of the resonator module. Moreover, when a multiple-stage RF linac is utilized, the phase difference (Φ) (in degrees(° )) of each accelerating electrode output signal is included within the required operational parameters.

When a multiple-stage RF linac is used, the amplitude, frequency and phase difference of the accelerating electrode output signals cannot be analytically determined using the incoming energy of the ions into the RF linac and the post-acceleration desired energy of the ions. This is because there are indefinite sets of solutions corresponding to the combination of required parameters.

In addition, when magnets (such as a quadrupole magnet or an electromagnet) are used for controlling the lateral spread of an ion beam during or after acceleration, or when electrostatic lenses (such as electrostatic quadrupole electrodes) are used to provide a convergence/divergence effect on the beam, their operation parameters (e.g., electrical current or voltage) must be also determined. However, such magnetic or electrostatic operational parameters cannot be determined until the RF linac parameters are determined, because the optimum values for these factors are altered depending on the energy of the ions passing therethrough. In addition, the strength of the electric field of the RF linac affects the convergence/divergence of the magnet or electrostatic lens. Furthermore, even after the RF linac parameters (amplitude, frequency, and phase) are determined, the magnetic or electrostatic operational parameters cannot be analytically determined but are instead calculated step by step.

As previously discussed, in an ion implantation apparatus in which ions are accelerated using an electrostatic voltage, acceleration parameters can be easily determined by analysis. Hence, if data such as an acceleration condition (the ionic valence value of ions) and a desired energy is entered by an operator or provided by a higher level computer, the necessary acceleration parameter (e.g., electrical current or voltage) can be calculated by a control device of the ion implantation apparatus and automatically determined by analytical solution of equations. FIG. 5 shows such a process for determining an electrostatic acceleration parameter.

However, in the case of an implantation apparatus including an RF linac, the RF linac operational parameters (amplitude, frequency and phase) and the parameters of a convergence/divergence lens which controls the convergence/divergence of an ion beam cannot be analytically obtained. As shown in FIG. 6, a typical process for determining the linac operational parameters involves first selecting combinations of parameter values that have previously been found to optimize operation of the RF linac for a particular desired target energy level. The selection is based on acceleration conditions and a desired final energy value. If the selected combination of parameter values results in achievement of the target energy value, the selected combination of parameters is used without changes.

If however, as is likely, the target energy value is not achieved using the selected combination of parameter values, the combination of parameter values that comes closest to achieving the target energy value is chosen to actually accelerate an ion beam. Then, by gradually changing the control parameters, a combination of parameters is found for obtaining a beam with the target energy. Through successive iterations, using trial-and-error operations that are necessary because changing one parameter affects the others, the parameters are adjusted gradually until an optimum combination of parameter values are found.

However, the process as shown in FIG. 6 requires a very large amount of time and effort to arrive at the optimum combination of operational parameters. In addition, one cannot be sure that the obtained combination of parameters is the optimum combination. Moreover, the adjustment must be performed by an operator and hence, an automatic start-up and operation cannot be achieved for an ion beam with a new set of operating conditions.

It is therefore a purpose of the present invention to provide quick and easy automatic calculation of RF linac operational parameters for an ion implantation apparatus. Another purpose of the present invention is to enable the generation of an ion beam having a desired energy level in a short period of time. Yet another purpose of the present invention is to enable operating parameters for a convergence/divergence lens in an ion implanter to be established with ease and in a short period of time.

SUMMARY OF THE INVENTION

The present invention provides an ion implantation apparatus which has an RF linear accelerator (linac) which produces ion energy of a desired value by accelerating or decelerating ions using a radio frequency (RF) field, and a control calculation device which automatically calculates at least one of the RF linac operational parameters, which are amplitude, frequency and phase. In particular, the control calculation device simulates the ion beam acceleration and deceleration based on numeric value calculation codes which are stored in advance therein and automatically calculates at least one of the RF linac operational parameters.

The RF linac has one or more RF power supplies and one or more amplitude control devices for controlling the amplitude of the output of the RF power supplies. The control calculation device includes logic that uses stored numeric value calculation codes to calculate a numeric value of the RF amplitude. This value controls the one or more amplitude control devices, which control the output voltage amplitudes of the one or more RF power supplies.

The RF linac has one or more RF power supplies and one or more phase control devices for controlling the phase of output of the RF power supplies. The control calculation device includes logic that uses the numeric value calculation codes to calculate a numeric value of the RF phase. This value controls the one or more phase control devices, which control the output voltage phases of the one or more RF power supplies.

The RF linac has one or more RF power supplies and one or more frequency control devices for controlling the frequency of the output of the RF power supplies. The control calculation device includes logic that uses the numeric value calculation codes to calculate a numeric value of the RF. This value controls the one or more frequency control devices, which control the output voltage frequencies of the one or more RF power supplies.

The RF linac has one or more RF resonators and one or more frequency control devices for controlling the resonance frequency of the RF resonators. The control calculation device includes logic that uses the numeric value calculation codes to calculate a numeric value of the RF frequency. This value controls the one or more frequency control devices, which control the resonance frequencies of the one or more RF resonators.

The present inventions also provide an ion implantation apparatus which includes convergence/divergence lenses for efficiently transporting the ion beam by converging and diverging the ions in the beam, and a control calculation device that automatically calculates at least one of the parameters of the convergence/divergence lenses, which are electrical current and voltage. In the present invention, the control calculation device includes logic that simulates the ion beam acceleration and deceleration based on the numeric value calculation codes that are stored in advance therein, and automatically calculates parameters of the convergence/divergence lenses.

The control calculation device of the present invention can provide a combination of RF linac operational parameters (amplitude, frequency and phase) so that the transmission efficiency of an ion beam through the linac is maximized using stored numeric value calculation codes. Furthermore, the control calculation device of the present inventions can also calculate the operational parameters of convergence/convergence lenses, which control conversion and diversion of an ion beam, using stored numeric value calculation codes.

DETAILED DESCRIPTION OF A PREFERRED EMBODIMENT

Figure 1:
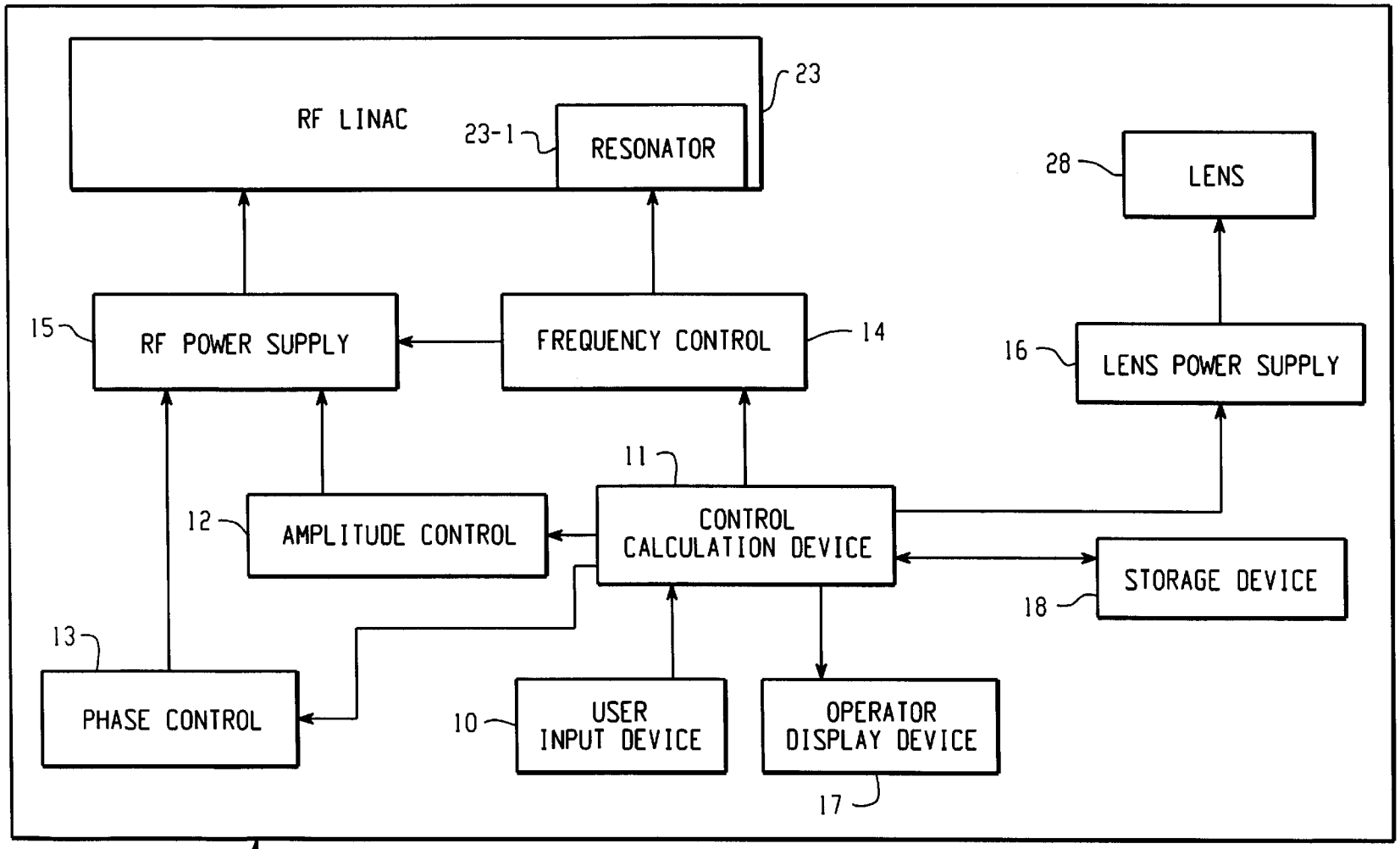
FIG. 1 is a block diagram, which illustrates the design of a control system for an ion implantation apparatus including both an RF linac and one or more convergence/divergence lenses to which the present invention is applied.

Referring now to the drawings, FIG. 1 shows a block diagram representative of an ion implantation apparatus 1 utilizing an RF linac 23. A user input device 10 sends signals to a control calculation device 11 that receives (and stores) calculation codes from a storage device 18. The control calculation device sends signals to an operator display device 17. In addition, the control calculation device 11 sends signals to an amplitude control device 12, a phase control device 13, a frequency control device 14. Still further, the control calculation device sends signals to a convergence/divergence lens power supply 16 that powers a convergence/divergence lens 28.

The amplitude control device 12 and the phase control device 13 send signals to the RF power supply 15 that powers the RF linac 23. The frequency control device 14 sends signals to the RF power supply 15 that powers the RF linac 23, and sends signals to the RF resonator portion 23-1 of the linac 23.

Figure 2:
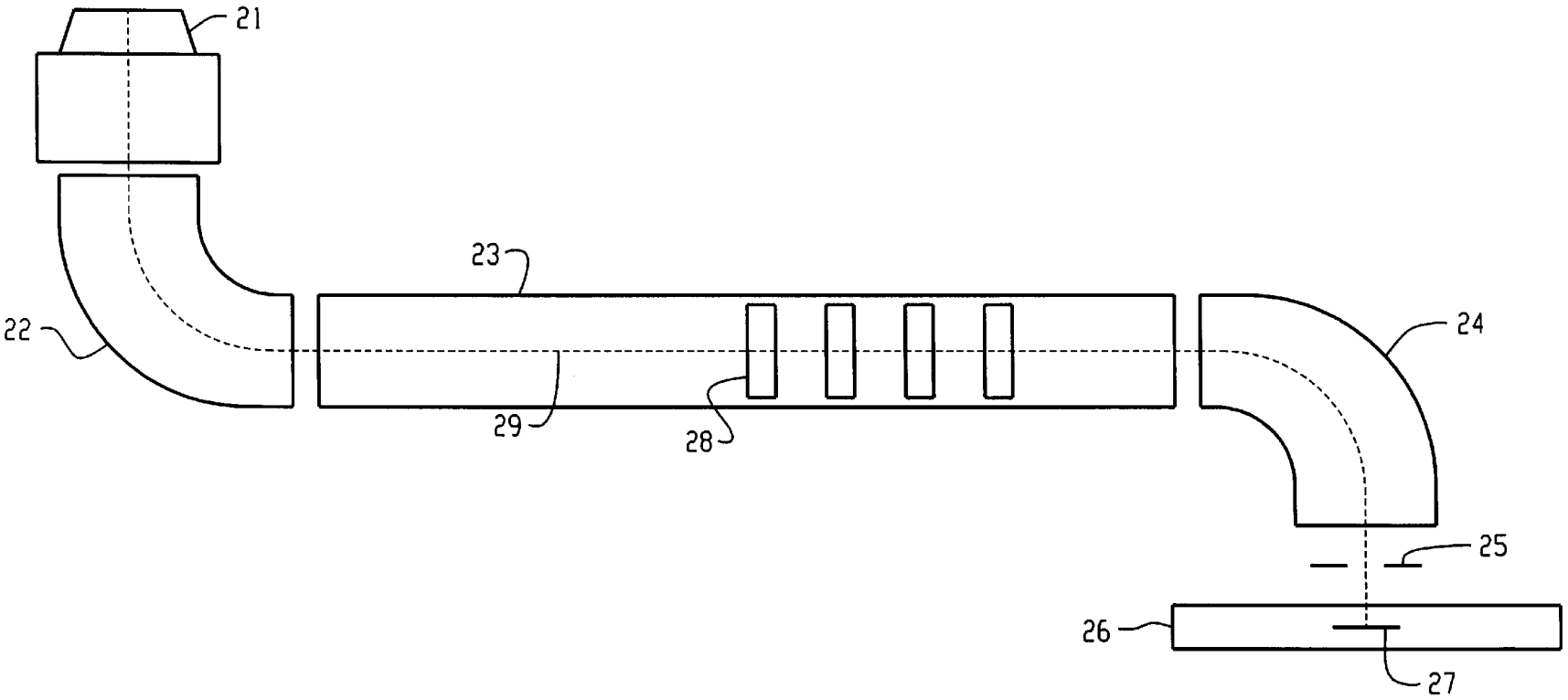
FIG. 2 is a plan view of the ion implantation apparatus of FIG. 1.

In FIG. 2, a plan view of the ion implantation apparatus 1 of FIG. 1 is shown. An ion beam, represented by line 29, is extracted out of an ion source 21 and then passes through a mass analysis electromagnet 22 and is directed to an RF linac 23, which applies RF acceleration only on desired ions that pass through the mass analysis electromagnet 22. RF linac 23 can accelerate or decelerate an ion beam using the effect of RF fields, in a known manner. The accelerated or decelerated ion beam is deflected by an energy analysis electromagnet 24 and then undergoes energy analysis using a separation slit 25. Ions that pass through separation slit 25 are implanted into a wafer 27 in an implantation process chamber 26. A number of convergence/divergence lenses 28 for efficiently transporting the ion beam are placed in, in front of, or behind RF linac 23.

Referring back to FIG. 1, the control system of RF linac 23 and convergence/divergence lens 28 is explained. Constituting the elements necessary for controlling RF linac 23 and lens (or lenses) 28 are: an input device 10 used for entering necessary conditions by an operator, a control calculation device 11 used for calculating values of various parameters from the entered conditions and for further controlling each constituting element, an amplitude control device 12 used for adjusting the RF amplitude, a phase control device 13 used for adjusting the RF phase, a frequency control device 14 used for adjusting the RF frequency, an RF power supply 15, a convergence/divergence lens power supply 16 used for convergence/divergence lens 28, a display device 17 used for displaying operation parameters, and a storage device 18 used for storing determined parameters. Moreover, numeric value calculation codes (programs) for calculating values of various parameters are stored in storage device 18 in advance. As previously discussed, RF linac 23 includes one or more RF resonators 23-1.

Next, the operation of the ion implantation apparatus 1 is explained. An operator or a higher level computer enters into input device 10 the desired type of ions, the ionic valence value of ions, the extraction voltage of ion source 21, and the ion or ion beam energy value which is needed at the process chamber end of the machine. Using the internally stored numeric value calculation codes in parameter storage device 18, logic in the control calculation device 11 simulates the ion beam acceleration or deceleration, and the diversion/dispersion of the ion beam and calculates the RF linac operational parameters (amplitude, frequency and phase) for obtaining an optimum transport efficiency. At the same time, the control calculation device 11 calculates operational parameters (at least the electrical current or electrical voltage) of convergence/divergence lenses 28 for efficiently transporting an ion beam. The calculated various parameters are displayed on display device 17. As for the acceleration or deceleration conditions which are beyond the capability of RF linac 23, a message indicating that there are no solutions is displayed on display device 17.

Among the parameters, the parameter related to the amplitude is sent from control calculation device 11 to amplitude control device 12, which adjusts the amplitude of the output of RF power supply 15. The parameter related to the phase is sent to phase control device 13, which adjusts the phase of the output of RF power supply 15. The parameter related to the frequency is sent to frequency control device 14. Frequency control device 14 controls the output frequency of RF power supply 15 while it also controls the resonance frequency of RF resonator 23-1 of RF linac 23. Control calculation device 11 also controls convergence/divergence lens power supply 16 using the calculated parameters for the convergence/divergence lenses 28.

Ions which enter RF linac 23 and convergence/divergence lenses 28, whose operations are controlled as described above, are accelerated or decelerated to the desired energy and deflected by energy analysis electromagnet 24. Then, the ions undergo energy analysis using separation slit 25. The ions that pass through separation slit 25 are implanted into wafer 27 in implantation process chamber 26.

The various parameters that are calculated using the numeric value calculation codes are stored in parameter storage device 18, after the calculation or the actual operation to obtain a beam. The control calculation device 11 simulates the acceleration or deceleration of an ion beam based on the numeric value calculation codes which are stored in advance, and automatically calculates at least one of the RF parameters of amplitude, frequency and phase. The control calculation device 11 can then operate the ion implantation apparatus by reading the stored parameters. Thus, thereafter, the desired ion beam can be obtained merely by reference to the stored parameters and without numeric calculations.

Specific conditions (such as the geometrical dimensions, number of acceleration stages, a utilized frequency band, the maximum value of the amplitude, the number of convergence/divergence lenses, the maximum values thereof and so forth) of the RF linac and the convergence/divergence lens system of the ion implantation apparatus, can be incorporated into the numeric value calculation codes which are stored by control calculation device 11 in storage device 18. In this manner, a set of the codes can be switched for various types of RF linac systems and convergence/divergence lens systems.

Figure 3:
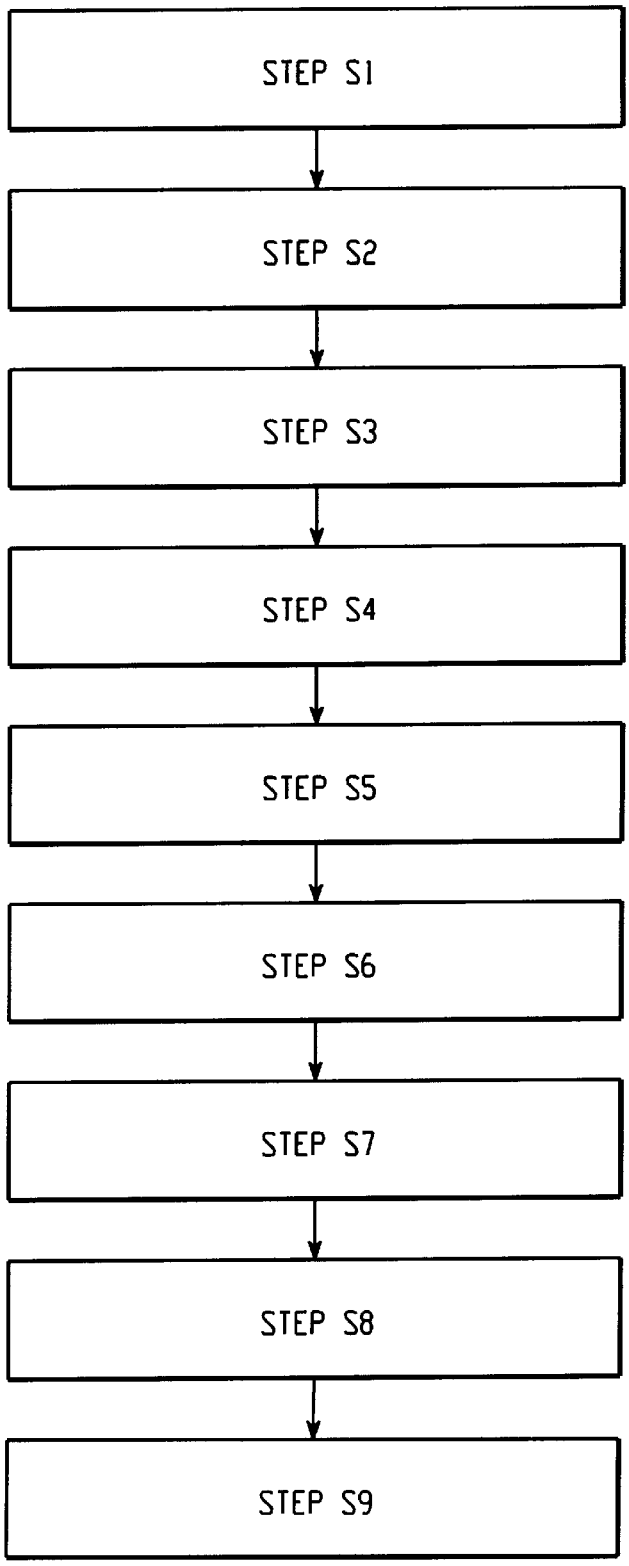
FIG. 3 is a flow chart showing the calculation procedure for determining the optimum linac operational parameters for the RF linac in the ion implantation apparatus of FIGS. 1 and 2.

Next, with reference to FIG. 3, the calculation procedure based on the numeric value calculation codes is explained. Here, the explanation is performed for a case in which RF resonators 23-1 consist of the first through fourth RF resonators. The process includes nine steps, referenced herein as S1–S9.

In Step S1, an operator or a higher level computer enters the calculation conditions into input device 10. Here, an ion source extraction voltage, an ion mass, and an ionic valence value of ions are entered as incoming beam conditions, and the final energy value EF of the ions or ion beam is entered as an outgoing beam condition. In Step S2, the initialization calculation is performed. In other words, a plurality of outgoing beam energy values (E1 through E8) are calculated using the predetermined eight combinations of phase and voltage for the given incoming beam conditions. Here, E1 is the theoretically the lowest energy and E8 the largest energy. The combinations of phase and voltage are determined so that the outgoing energy levels E1 through E8 are separated by approximately the same energy incremental values.

In Step S3, the final energy value EF and each of the calculated outgoing beam energy values (E1 through E8) are compared. In Step S4, conversion calculation is performed. In the conversion calculation, if for example, E4<EF<E5, then the value of voltage or phase is altered between the conditions of E4 and E5 until an outgoing beam energy becomes equal to the desired final energy value EF. In Step S5, temporary operational parameters for the RF linac are obtained as a result of repeated calculations of Step S4. In Step S6, the optimization of the bunching phase (first resonator) of the linac is performed. In other words, using the temporary parameters as the initial set, the phases of the resonance frequencies of the second through fourth RF resonators are varied until a phase combination which maximizes the transport efficiency of RF linac 23 is found.

In Step S7, RF linac operational parameters are obtained as the result of Step S6. In Step S8, optimization for convergence/divergence lenses 28 is performed. In other words, simulation for the ion beam is performed by varying the parameters of convergence/divergence lenses 28 against the RF parameters of RF linac 23 which are obtained in the above step. The simulation includes the lateral spread of the ion beam. Thus, the strength of convergence/divergence lenses 28 for the maximum transport efficiency is obtained.

In the final step S9, the final parameters are obtained. This is done by combining the RF parameters with the parameters for the convergence divergence lenses 28. As previously discussed, in the prior art, parameters are determined within an ion implantation apparatus and the determination provides analytical solutions (in other words, the solution of equations). Conversely, the most prominent feature of the present invention lies in the improvement by which numeric value calculation codes have been developed so that they can be applied to an RF acceleration system or convergence lens system for which analytical solutions cannot be obtained. Simulation utilizing numerical calculation is performed within an ion implantation apparatus and thereby parameters can be automatically determined.

Figure 4:
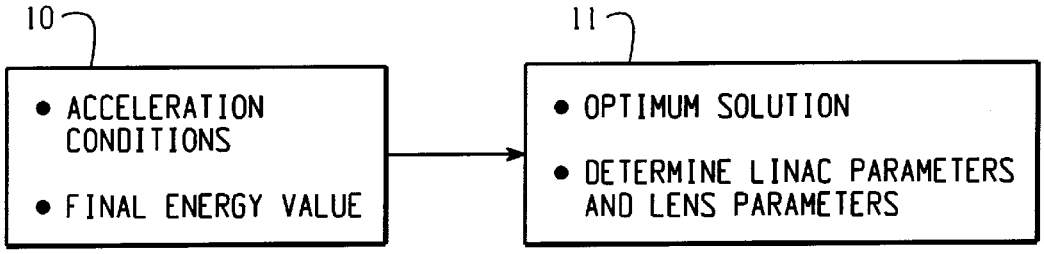
FIG. 4 is a flow chart showing the automatic calculation procedure outlined by FIG. 3 as applied to ion implantation apparatus of FIGS. 1 and 2, showing operator interaction with a control calculation device by means of an input device.
Figure 5:
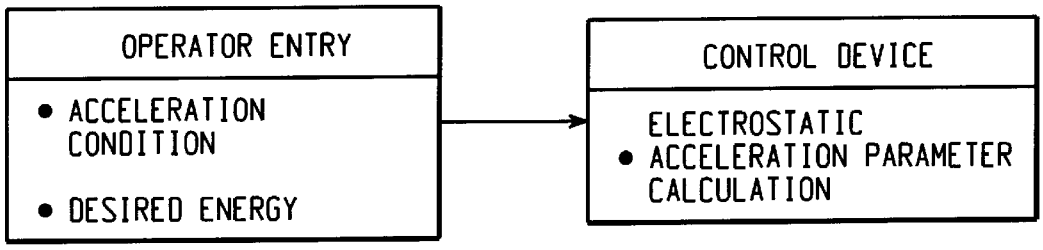
Fig. 5 PRIOR ART
FIG. 5 is a flow chart showing a prior art process for determining electrostatic acceleration parameters in an ion implantation apparatus.
Figure 6:
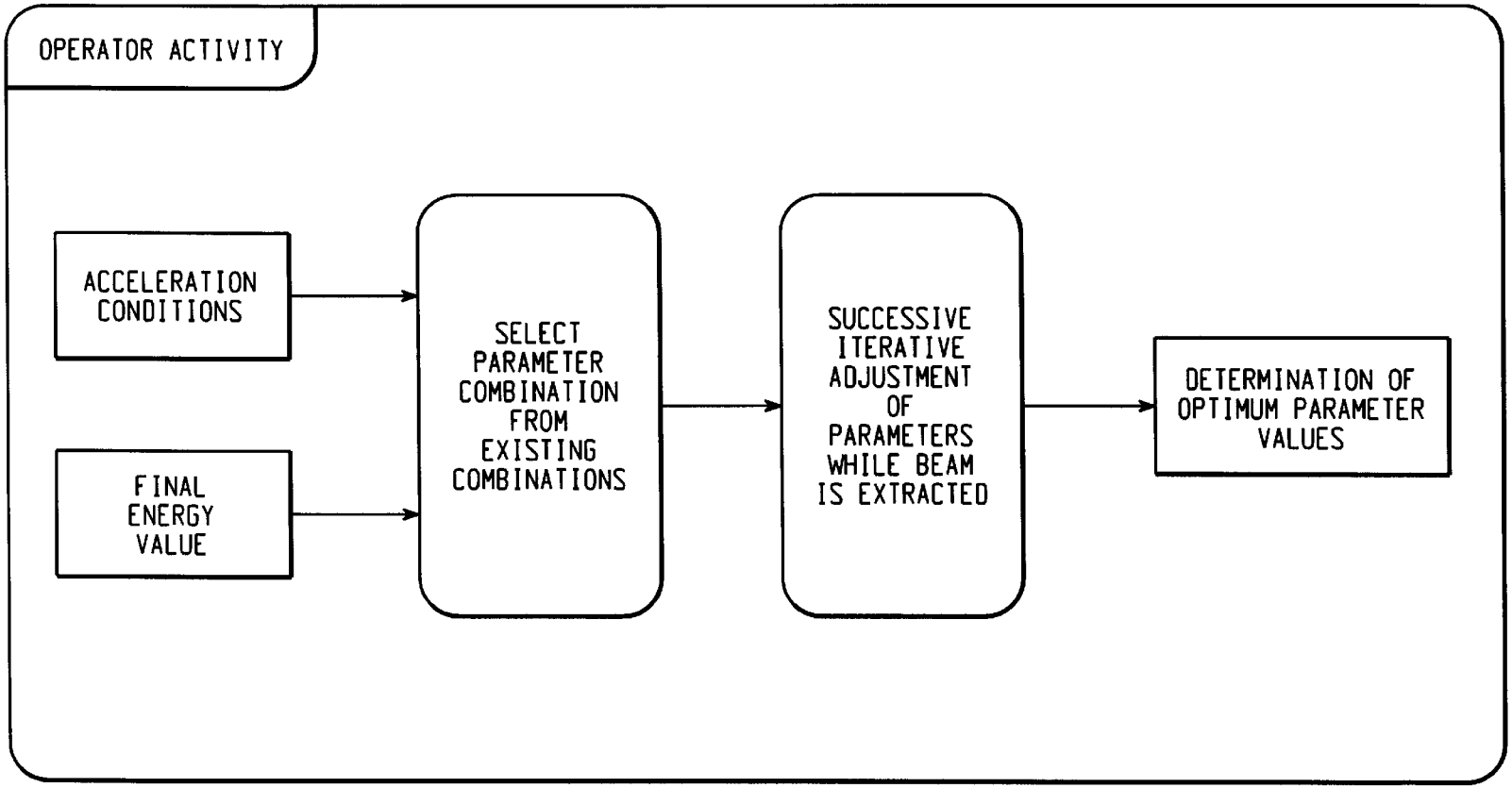
Fig. 6 PRIOR ART
FIG. 6 is a flow chart showing a prior art process for determining RF linac operational parameters.

Acceleration parameters of an RF system or parameters of convergence/divergence lenses for totally new acceleration conditions were conventionally obtained by expending a very large amount of effort and time through a procedure such as the one illustrated in FIG. 6. The present inventions allow such parameters to be automatically determined by merely an operator or a higher level computer entering acceleration conditions (e.g., ionic valence value of ions, a desired energy value, etc.). FIG. 4 briefly illustrates the entire procedure. An operator enters the acceleration conditions and a final energy value into the input device 10, and the control calculation device 11 determines the optimum solution (by numeric simulation), and determines the linac and convergence/divergence lens operational parameters. In other words, the operation can now be performed with the same ease as the operation performed for a prior art ion implantation apparatus that accelerates ions utilizing an electrostatic field.

Thus, regarding the process to determine a new set of linac operational parameters, there are advantages. The time required to determine the parameters is drastically reduced (approximately one minute according to the experiment results.) Effort by an operator to determine parameters is almost eliminated. Optimum parameters can be determined without iteration by trial-and-error. The quality of determined parameters does not depend on the skill of an operator and hence, is reproducible. Even when a higher level computer enters acceleration conditions or a final energy value, the apparatus of the present invention can automatically determine the parameters. Hence, it is possible to achieve completely automatic operation of the apparatus.

As explained hereinabove, according to the present invention, operating conditions of an ion implantation apparatus that utilizes an RF acceleration method can be determined with ease in a short period of time. Moreover, an ion beam having any energy value can be obtained in a short period of time.

Accordingly, a preferred embodiment has been described for a method and system for optimizing linac operational parameters in an ion implantation apparatus. With the foregoing description in mind, however, it is understood that this description is made only by way of example, that the invention is not limited to the particular embodiments described herein, and that various rearrangements, modifications, and substitutions may be implemented with respect to the foregoing description without departing from the scope of the invention as defined by the following claims and their equivalents.

What we claim is:

1. A system for in situ controlling the operational parameters of a radio frequency (RF) linear accelerator (linac) (23) in an ion implanter (1), comprising:

(i) a user input device (10) for accepting from a user numeric value calculation codes and data representing necessary operational conditions of the linac;

(ii) a control calculation device (11) for (a) storing the numeric value calculation codes and the data representing necessary operational conditions, (b) calculating one or more operational parameters for the linac based on said numeric value calculation codes and said data; and (c) outputting one or more control signals; said control calculation device including means for simulating the acceleration or deceleration of an ion beam based on said numeric value calculation codes and said data, and for automatically calculating at least one of said operational parameters and outputting at least one of said control signals; and (iii) control devices (12, 13, 14) for receiving said one or more control signals and, in response thereto, controlling said operational parameters of the linac (23).

2. The system of claim 1, wherein said operational parameters of the linac (23) include phase, frequency, and amplitude of an output signal of the linac.

3. The system of claim 2, wherein said control devices include an amplitude control device (12), a phase control device (13), and a frequency control device (14).

4. The system of claim 3, wherein said control calculation device (11) includes a storage device (18) for storing said numeric value calculation codes and the data representing necessary operational conditions.

5. The system of claim 3, wherein further comprising an operator display device (17).

6. The system of claim 3, wherein the linac (23) has one or more RF power supplies (15) and one or more amplitude control devices (12) for controlling the amplitude of the outputs of the RF power supplies, and said control calculation device (11) uses said numeric value calculation codes and said data to calculate a numeric value of the RE amplitude, whereby the calculated value controls said one or more amplitude control devices (12), which control the output voltage amplitudes of said one or more RF power supplies.

7. The system of claim 3, wherein the linac (23) has one or more RF power supplies (15) and one or more phase control devices (13) for controlling the phase of the outputs of the RF power supplies, and said control calculation device uses said numeric value calculation codes and said data to calculate a numeric value of the RF phase, whereby the calculated value controls said one or more phase control devices (13), which control the output voltage phase of said one or more RF power supplies.

8. The system of claim 3, wherein the linac has one or more RF power supplies (15) and one or more frequency control devices (14) for controlling the frequency of the outputs of the RF power supplies, and said control calculation device uses said numeric value calculation codes and said data to calculate a numeric value of the RE frequency, whereby the calculated value controls said one or more frequency control devices (14), which control the output voltage frequency of said one or more RF power supplies.

9. The system of claim 3, wherein the linac has one or more RE resonators (23-1) and one or more frequency control devices (14) for controlling the resonance frequency of the RF resonators, and said control calculation device uses said numeric value calculation codes and said data to calculate a numeric value of the RE frequency, whereby this calculated value controls said one or more frequency control devices (14), which control the resonance frequencies of said one or more RE resonators.

10. The system of claim 3, wherein said numeric value calculation codes can be altered according to the geometrical dimensions of the ion implantation apparatus, the number of RF acceleration stages, a utilized frequency band, and the maximum value of the amplitude.

11. The system of claim 3, wherein said user input device (10) provides means by which an operator or a higher level computer can enter conditions such as a desired type of ions, ionic valence value of ions, and the final implantation energy value, wherein said control calculation device automatically calculates all or part of RF parameters, which are amplitude, frequency and phase, under the entered conditions so that a desired ion beam is thereby automatically created.

12. A method of in situ controlling the operational parameters of a radio frequency (RF) linear accelerator (linac) (23) in an ion implanter (1), comprising:

(i) accepting from a user input device (10) numeric value calculation codes and data representing necessary operational conditions of the linac;

(ii) (a) storing the numeric value calculation codes and the data representing necessary operational conditions, (b) automatically calculating one or more operational parameters for the linac by simulating the acceleration or deceleration of an ion beam using said numeric value calculation codes and said data; and (c) outputting one or more control signals; and (iii) receiving said one or more control signals with control devices (12, 13, 14) which respond thereto by controlling said operational parameters of the linac (23).

13. The method of claim 12, wherein said operational parameters of the linac (23) include phase, frequency, and amplitude of an output signal of the linac.

14. The method of claim 13, wherein said control devices include an amplitude control device (12), a phase control device (13), and a frequency control device (14).

15. The method of claim 14, wherein the linac (23) has one or more RF power supplies (15) and one or more amplitude control devices (12) for controlling the amplitude of the outputs of the RF power supplies, and said numeric value calculation codes and said data are used to calculate a numeric value of the RF amplitude, whereby the calculated value controls said one or more amplitude control devices (12), which control the output voltage amplitudes of said one or more RF power supplies.

16. The method of claim 14, wherein the linac (23) has one or more RF power supplies (15) and one or more phase control devices (13) for controlling the phase of the outputs of the RF power supplies, and said numeric value calculation codes and said data are used to calculate a numeric value of the RF phase, whereby the calculated value controls said one or more phase control devices (13), which control the output voltage phase of said one or more RF power supplies.

17. The method of claim 14, wherein the linac has one or more RF power supplies (15) and one or more frequency control devices (14) for controlling the frequency of the outputs of the RF power supplies, and said numeric value calculation codes and said data are used to calculate a numeric value of the RF frequency, whereby the calculated value controls said one or more frequency control devices (14), which control the output voltage frequency of said one or more RF power supplies.

18. The method of claim 14, wherein the linac has one or more RF resonators (23-1) and one or more frequency control devices (14) for controlling the resonance frequency of the RF resonators, and said numeric value calculation codes and said data are used to calculate a numeric value of the RF frequency, whereby this calculated value controls said one or more frequency control devices (14), which control the resonance frequencies of said one or more RF resonators.

19. The method of claim 14, wherein said numeric value calculation codes can be altered according to the geometrical dimensions of the ion implantation apparatus, the number of RF acceleration stages, a utilized frequency band, and the maximum value of the amplitude.

20. The method of claim 14, wherein said user input device (10) provides means by which an operator or a higher level computer can enter conditions such as a desired type of ions, ionic valence value of ions, and the final implantation energy value, wherein said control calculation device automatically calculates all or part of RF parameters, which are amplitude, frequency and phase, under the entered conditions so that a desired ion beam is thereby automatically created.

* * * * *